US011634957B2

(12) United States Patent
Saltarelli

(10) Patent No.: US 11,634,957 B2
(45) Date of Patent: Apr. 25, 2023

(54) PERFORATING GUN BRAKE AND SET DEVICE AND METHOD

(71) Applicant: GEODYNAMICS, INC., Millsap, TX (US)

(72) Inventor: Terrell Saltarelli, Weatherford, TX (US)

(73) Assignee: GEODYNAMICS, INC., Millsap, TX (US)

( * ) Notice: Subject to any disclaimer, the term of this patent is extended or adjusted under 35 U.S.C. 154(b) by 0 days.

(21) Appl. No.: 17/329,764

(22) Filed: May 25, 2021

(65) Prior Publication Data

US 2021/0388687 A1 Dec. 16, 2021

Related U.S. Application Data

(60) Provisional application No. 63/037,070, filed on Jun. 10, 2020.

(51) Int. Cl.

| | |
|---|---|
| ***E21B 23/04*** | (2006.01) |
| ***E21B 43/117*** | (2006.01) |
| ***E21B 47/12*** | (2012.01) |
| ***E21B 47/06*** | (2012.01) |
| ***E21B 43/1185*** | (2006.01) |

(52) U.S. Cl.

CPC ..... *E21B 23/042* (2020.05); *E21B 23/0411* (2020.05); *E21B 43/117* (2013.01); *E21B 43/11855* (2013.01); *E21B 47/06* (2013.01); *E21B 47/12* (2013.01)

(58) Field of Classification Search

CPC .. E21B 23/042; E21B 23/04; E21B 23/04115; E21B 43/117

See application file for complete search history.

(56) References Cited

U.S. PATENT DOCUMENTS 2,509,608 A * 5/1950 Penfield ..... E21B 49/10 166/212
3,058,522 A * 10/1962 McElheny ..... E21B 43/11852 175/4.54
4,375,834 A * 3/1983 Trott ..... E21B 43/1185 175/4.51
5,700,968 A * 12/1997 Blimke ..... E21B 43/1185 175/4.54
6,152,233 A * 11/2000 Jani ..... E21B 23/01 166/134
6,223,818 B1 * 5/2001 Hrupp ..... E21B 43/118 166/63

(Continued)

*Primary Examiner* — Shane Bomar

(74) *Attorney, Agent, or Firm* — Morgan, Lewis & Bockius LLP

(57) ABSTRACT

A braking and setting device is configured to slow down a movement of a tool in a well and to fix the tool relative to the well. The braking and setting device includes two or more arms configured to extend from the tool, toward the well, to brake the movement of the tool along a longitudinal axis X; a movable piston configured to be hosted fully within the tool and to move only when a well fluid acts on a base portion of the movable piston, while a tip portion of the movable piston pushes away the two or more arms; and an actuation mechanism configured to establish a fluid communication between the well fluid and the base portion of the movable piston. The movable piston moves exclusively due to a force exerted by the well fluid on the movable piston.

20 Claims, 11 Drawing Sheets

(56) References Cited

U.S. PATENT DOCUMENTS

| | | | | |
|---|---|---|---|---|
| 6,315,043 | B1 * | 11/2001 | Farrant | E21B 43/116 166/63 |
| 6,817,598 | B2 * | 11/2004 | Parrott | E21B 43/116 188/129 |
| 7,757,767 | B2 * | 7/2010 | Hill | E21B 43/119 166/212 |
| 9,217,305 | B2 * | 12/2015 | Coles | E21B 47/09 |
| 2001/0004016 | A1 * | 6/2001 | Hillyer | E21B 23/01 166/212 |
| 2004/0011533 | A1 * | 1/2004 | Lawrence | E21B 23/04 166/212 |
| 2005/0241835 | A1 * | 11/2005 | Burris | E21B 23/00 166/313 |
| 2011/0094406 | A1 * | 4/2011 | Marya | E21B 29/02 102/305 |
| 2019/0085685 | A1 * | 3/2019 | McBride | E21B 43/114 |
| 2020/0040680 | A1 * | 2/2020 | Mhaskar | E21B 23/01 |
| 2020/0332630 | A1 * | 10/2020 | Davis | E21B 43/119 |

* cited by examiner

PERFORATING GUN BRAKE AND SET DEVICE AND METHOD

BACKGROUND

Technical Field

Embodiments of the subject matter disclosed herein generally relate to a tool that is lowered into a casing of a well and needs to be fixed at a certain position in the well, and more specifically, to a braking and setting mechanism that achieves this functionality in the well.

Discussion of the Background

In the oil and gas field, once a well is drilled to a desired depth H relative to the surface, and the casing protecting the wellbore has been installed and cemented in place, it is time to connect the wellbore to the subterranean formation to extract the oil and/or gas. This process of connecting the wellbore to the subterranean formation may include a step of fluidly insulating with a plug a previously fractured stage of the well, a step of perforating a portion of the casing, which corresponds to a new stage, with a perforating gun such that various channels are formed to connect the subterranean formation to the inside of the casing, a step of removing the perforating gun, and a step of fracturing the various channels of the new stage by pumping a fluid into the channels. These steps are repeated until all the stages of the well are fractured.

During one or more of these steps, it is often the case that a perforating gun needs to be deployed in a certain stage, at a predetermined position in the well, and be fired so that the shaped charges of the perforating gun establish channels between the inside of the casing and the oil formation around the casing, thus achieving a fluid communication between the inside and outside of the casing. Positioning the perforating plug to the desired location in the well is typically achieved with a wireline or similar tool. Once the perforating gun has arrived in position, its shaped charges are fired to create perforations into the casing of the well. After one or all of the perforating guns are fired, they are pulled out of the well with the wireline.

However, more recent perforating guns are released into the well without a wireline or with a slickline, with the intent of not retrieving them from the well. For this case, most parts of the perforating gun may be dissolvable, which means that they can be left inside the well and they will eventually dissolve and disappear. For this kind of perforating guns, no wireline may be used to deploy then. These perforating guns are simply released inside the well and driven by pumping a fluid behind them until the guns arrive at the desired position in the well. As there is no wireline to stop the movement of the perforating guns inside the well, or the used slickline cannot withstand the tension generated by the moving perforating guns, a braking mechanism has been provided to each perforating gun and this braking mechanism is configured to be deployed to the desired location in the well where the perforating gun should be fired to fix the gun at that position.

The existing braking mechanisms use an ignitor (a detonating material) which is configured to ignite a power charge inside the perforating gun, and this power charge actuates one or more arms to extend from the body of the perforating gun toward the casing of the well, and eventually to push against the casing to stop the movement of the perforating gun. Note that the ignitor and the power charge are in addition to the existing shaped charges, detonator cords, and detonators and these elements act independent of each other.

One of the problems with such a braking mechanism is that from a regulatory standpoint, in a perforating gun, every explosive must be accounted for, and the mixing of different types of explosives (explosive for the shaped charges, cords and detonators, and explosive for the braking mechanism, which are typically made of different materials) can change the shipping class of the perforating gun to a more sensitive classification, which makes the assembly and shipping of the perforating gun from the manufacturer to the operator of the well more cumbersome.

Thus, there is a need to eliminate the explosive material associated with the braking mechanism to at least simplify the regulatory aspects, but also to make the entire device less prone to accidents.

SUMMARY

According to an embodiment, there is a braking and setting device configured to slow down a movement of a tool in a well and to fix the tool relative to the well. The braking and setting device includes two or more arms configured to extend from the tool, toward the well, to brake the movement of the tool along a longitudinal axis X; a movable piston configured to be hosted fully within the tool and to move only when a well fluid acts on a base portion of the movable piston, while a tip portion of the movable piston pushes away the two or more arms; and an actuation mechanism configured to establish a fluid communication between the well fluid and the base portion of the movable piston. The movable piston moves exclusively due to a force exerted by the well fluid on the movable piston.

According to another embodiment, there is a perforating gun configured to slow down in a well and fix to a casing of the well. The perforating gun includes a body extending along a longitudinal axis X; one or more shaped charges configured to make a perforation in the well; a detonator cord connected to the one more shaped charges; and a braking and setting device partially located within the body and configured to slow down a movement of the body in the well and to fix the body relative to the well. The braking and setting device brakes and sets the body exclusively due to a force exerted by the well fluid.

According to still another embodiment, there is a method of deploying a perforating gun into a well with a braking and setting device. The method includes releasing the perforating gun into the well; sending a command to the perforating gun to actuate the braking and setting device; actuating an actuation mechanism, based on the received command, to open a fluid communication between a well fluid from the well and a movable piston of the braking and setting device; moving the movable piston exclusively due to a force exerted by the well fluid, where the movable piston pushes away two or more arms against a casing of the well to brake the perforating gun; and setting the perforating gun to be fixed relative to the casing with the two or more arms.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a single perforating gun used for perforating a casing in a horizontal well. However, the embodiments discussed herein may be used for plural perforating guns or other tools that are used in a well, and also for tools that are provided inside a vertical well.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

According to an embodiment, a perforating gun includes, in addition to the shaped charges, detonator, and detonation cord, a braking and setting mechanism that uses no ignitor and no power charge for braking and fixing the associated perforating gun to a desired position inside the well. The braking and setting mechanism is activated exclusively by a pressure of a fluid that is present in the well, i.e., the well pressure. The pressure of the fluid may be the hydrostatic pressure plus an applied pressure, which is applied by the operator of the well with a pump at the head of the well. An actuation mechanism, for example, a valve, is configured to open a passage that fluidly communicates the outside of the perforating gun with a wedge piston. The valve opens when a command is received and allows the well fluid to press on the wedge piston, to move the braking arms outside a body of the perforating gun, to contact the casing and stop the movement of the perforating gun. Details of these features are now discussed with regard to the figures.

Figure 1:
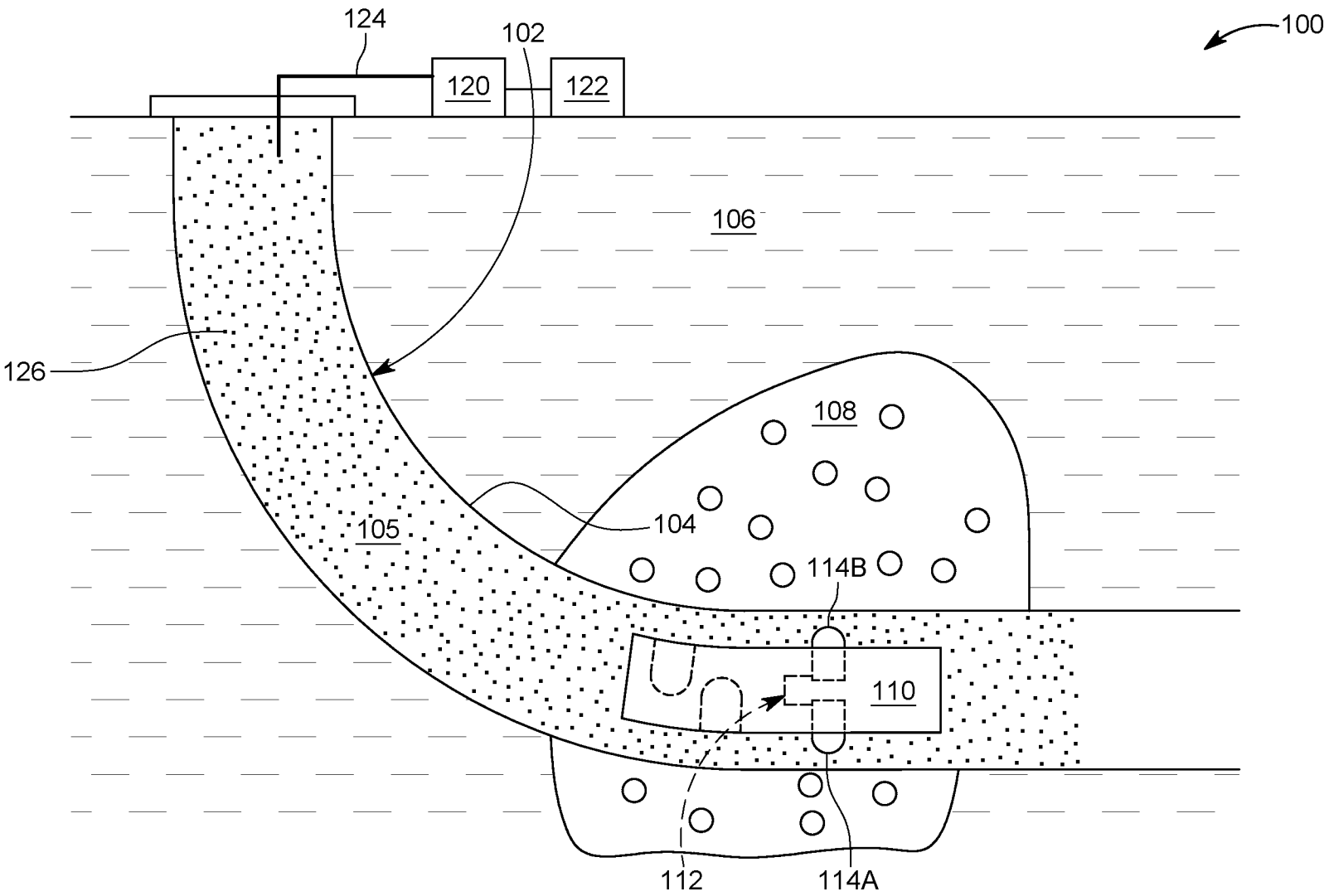
FIG. 1 illustrates a perforating gun having a braking and setting mechanism and the perforating gun is placed in a casing of a well for making perforations into the casing.

FIG. 1 shows a well system 100 that includes plural perforating guns 110 (only one is shown for simplicity) deployed inside a well 102. The well 102 has been cased with a casing 104, that separates the underground 106 and the oil formation 108 from the bore 105 of the casing 104. The perforating gun 110 is not connected to a wireline or similar device, i.e., the perforating gun 110 moves independently through the bore 105, although the invention is also applicable to perforating guns that are connected to a wireline. A pump 120 is connected to the head of the well and is configured to pump, when instructed by a controller 122, a desired fluid from a reservoir (not shown) into the well, through a conduit 124. This fluid makes the perforating gun 110 to move into the well, toward the toe of the well.

Figure 2:
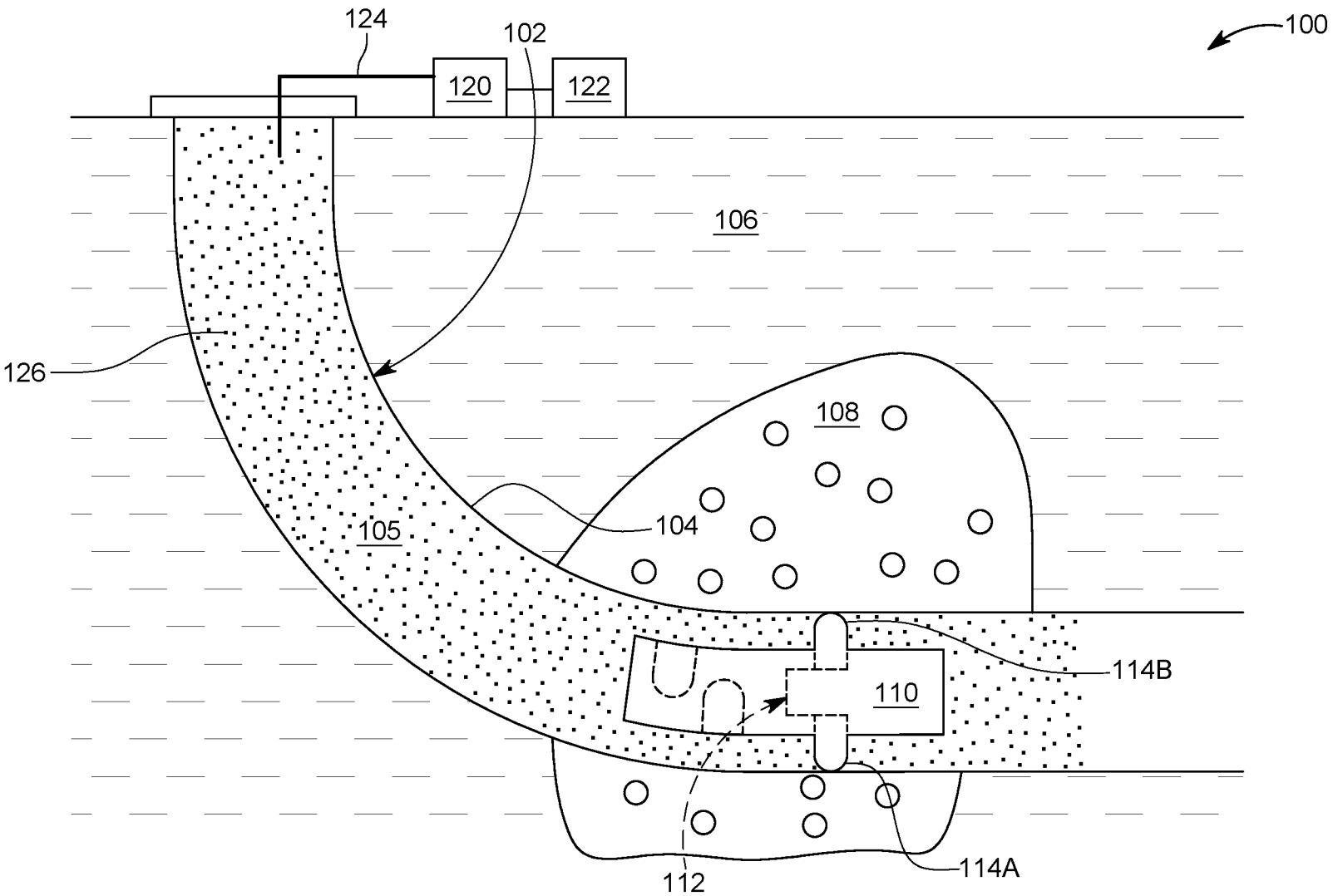
FIG. 2 illustrates the same perforating gun having the braking and setting mechanism deployed, so that the perforating gun is fixed to the casing of the well so that the gun cannot move.

When the perforating gun 110 arrives next to the oil formation 108, as illustrated in FIG. 1, the pressure of the fluid 126 inside the well may either be at a desired preset well pressure, or it may be increased with the pump 120, to the desired preset well pressure. A braking and setting mechanism 112 of the perforating gun 110 is activated with an electrical signal, which allows the preset well pressure to act on a moving piston, which results in the release of the two or more arms 114A, 114B from the housing of the perforating gun. In effect, the braking mechanism extends the two or more arms 114A, 114B toward the casing 104, until reaching the casing and fixing the perforating gun 110 relative to the casing, as shown in FIG. 2. At this time, the perforating gun is fixed in position and cannot move through the well.

Figure 3:
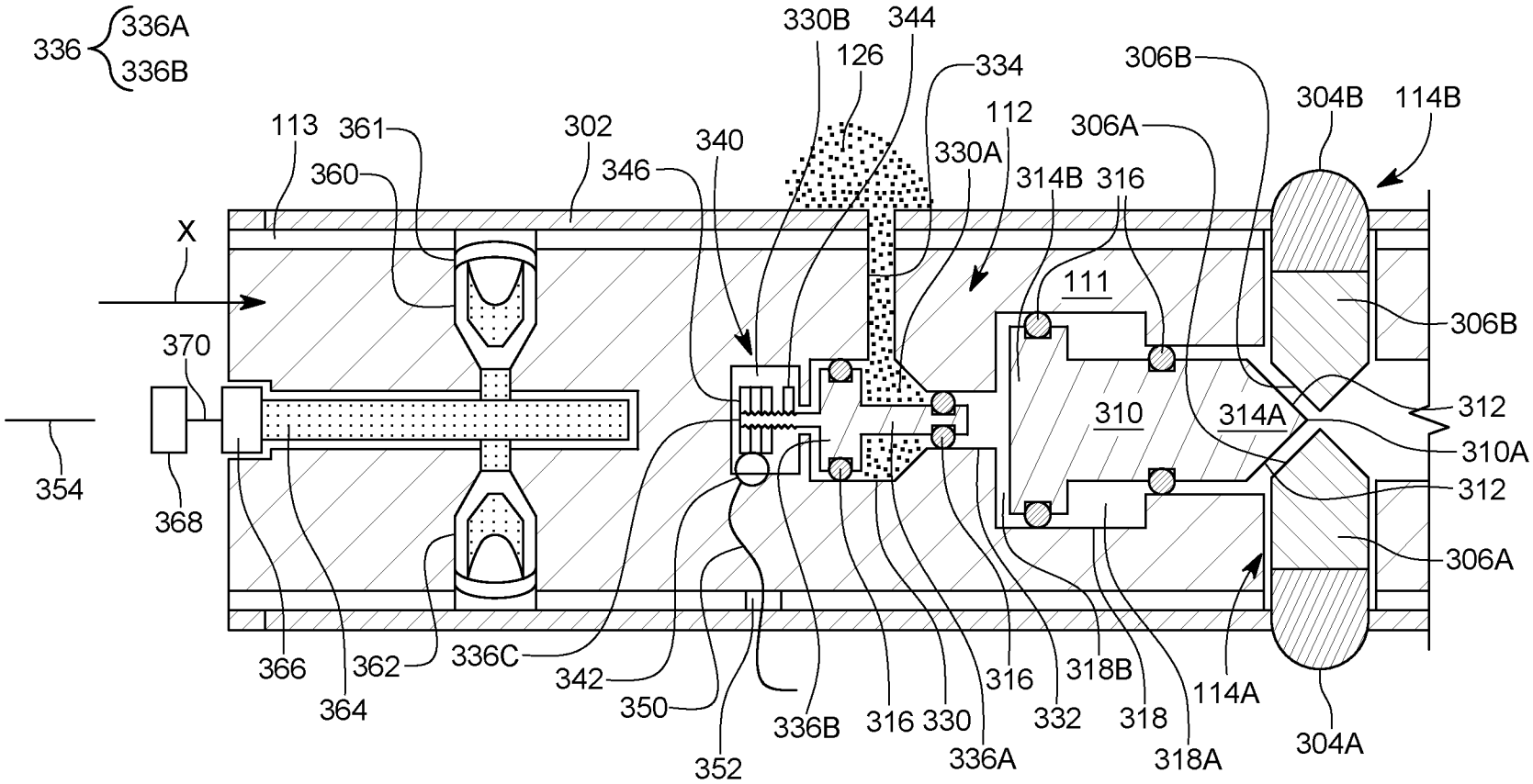
FIG. 3 shows details of the braking and setting mechanism of the perforating gun.

The braking and setting mechanism 112 is shown in more detail in FIG. 3 and includes the arms 114A and 114B, a movable piston 310, and an actuation mechanism 340, all of which are located, fully or partially, inside a body 111 of the perforating gun 110. The arms are mostly located inside the body 111, with small tip portions 304A, 304B extending outside a housing 302. Note that the housing 302 fully encloses the body 111 and there is an annular space 113 between the housing 302 and the body 111 that is sealed from the ambient well fluid 126. In one application, the tips 304A and 304B are flush with the housing 302. The arms also include base portions 306A and 306B that are fully located inside the body 111. While the base portions 306A and 306B may be made of a metal (for example, any known dissolvable metal or non-metal), the tip portions 304A and 304B may be made of rubber or other composite material, that exhibits a large friction with the wall of the casing. The base portions 306A and 306B may be shaped to have an inclined surface 308A and 308B, respectively, as shown in FIG. 3. These surfaces are shaped to match corresponding inclined surfaces 312 of a movable piston 310, which is fully housed inside the body 111. The movable piston 310 has a tip 310A that is configured to enter between the base portions 306A and 306B of the arms 114A and 114B, respectively, to push away the two arms to engage them with the casing 104 as shown in FIG. 2.

The movable piston 310 may be made from a dissolvable metal or a composite material that can be easily drilled. The movable piston 310 also has a base portion 314B, and the base portion is shaped as a cylinder. The tip portion 314A has a smaller diameter than the base portion 314B. One or more o-rings 316 are placed around the movable piston 310 to seal an interface between the movable piston and a first internal chamber 318 located inside the body 111. The first internal chamber 318 fluidly communicates with a second internal chamber 330, also located inside the body 111. While the first internal chamber 318 hosts the movable piston 310, the second internal chamber 330 hosts an actuation mechanism 340. The first internal chamber 318 fluidly communicates with the second internal chamber 330 through a passage 332. The second internal chamber 330 also fluidly communicates with an ambient of the housing 302, i.e., with the well fluid 126, through a dedicated passage 334. The passage 334 is configured to not allow the well fluid 126 to enter in the annulus space 113, between the housing 302 and the body 111. While the well fluid 126 can freely enter from the casing 104, through the passage 334, into a first sub-chamber 330A of the second internal chamber 330, the well fluid 126 is prevented by the o-rings 316 from entering a second sub-chamber 330B. The second sub-chamber 330B is separated from the first sub-chamber 330A by a second movable piston 336. The second movable piston 336 includes a tip portion 336A and a base portion 336B. The tip portion 336A has a smaller diameter than the base portion 336B. The tip portion 336A is configured to exactly fit inside the passage 332 to prevent the well fluid 126 from entering from the first sub-chamber 330A into a second sub-chamber 318B of the first internal chamber 318. In this regard, note that the movable piston 310 and more precisely the base portion 314B of the movable piston 310 splits the first internal chamber 318 into a first sub-chamber 318A and the second sub-chamber 318B. Also note that the base portion 314B of the movable piston 310 fluidly insulates the first sub-chamber from the second sub-chamber due to the o-ring 316.

Returning to the actuation mechanism 340, it includes, in this embodiment, a fuse 342 which is configured to hold a spring 344 (compressional or torsional) tightly wound around a split nut 346 (see, for example, U.S. Patent Publication no. US2018/0347314, which is incorporated herein by reference and is assigned to the present assignee). The split nut 346 is preventing the moving piston 336 from shifting, and thus, from allowing the well fluid 126 to move into the passage 332. The split nut 346 is located on an extension 336C of the base portion 336B. Note that also because the diameter of the base portion 336B is larger than the diameter of the top portion 336A of the moving piston 336, the pressure exerted by the well fluid on the movable piston 336 is opposite to the positive direction of the longitudinal axis X of the perforating gun, thus, further preventing the second movable piston 330 from opening the passage 332.

The fuse 342 is connected to a signal wire 350, that exits through a port 352 from the housing 302 of the perforating gun 110. When an electrical signal is sent through the signal wire 350, the fuse 342 burns, and the spring 344 springs outwardly releasing the segments of the split nut 346, and thus allowing the moving piston 336 to move to the left in the figure, i.e., along the negative direction of the longitudinal axis X. When this happens, the tip portion 336A of the moving piston 336 exits the passage 332 and allows the well fluid 126 to enter from the passage 334 into the first chamber 318, to exert a pressure on the first movable piston 310.

While FIG. 3 shows the signal wire 350 extending outside the housing 302, in one embodiment it is possible that the port 352 is a sensor and the wire 350 ends at the sensor 352. The sensor 352 may be a pressure sensor or a sound sensor. If the element 352 is a port, then the wire 350 may be connected to a slickline 354, so that the perforating gun is tethered to the slickline 354, i.e., the perforating gun is semi-autonomous. However, if the element 352 is a sensor, then no wireline is present and the perforating gun is fully autonomous. The actuation mechanism 340 may be implemented in a different configuration, that does not include a split nut and spring, as long as an element is present that releases the second movable piston 336 when an electrical signal is applied to it so that the second movable piston allows the well fluid to enter inside the body 111 and exert a force directly on the first movable piston 310.

When this happens, the well fluid 126 enters the second sub-chamber 318B of the first chamber 318 and applies a force directly on the movable piston 310. As the pressure inside the first sub-chamber 318A (atmospheric pressure) of the first chamber 318 is much smaller than the well fluid pressure inside the second sub-chamber 3186, and also because the force exerted by the well pressure on the tip portion 314A of the movable piston is smaller than the force exerted on the base portion 314B, the first movable piston 310 is forced to move to the right in the figure, in the positive direction of the longitudinal axis X, which results in pushing away the arms 114A and 1146 of the braking and setting mechanism 112. In this way, due exclusively to the pressure of the well fluid 126, the braking and setting mechanism is activated and the perforating gun 110 housing this mechanism is fixed in place inside the casing, at a desired location. Note that the well fluid pressure is either given by the hydrostatic pressure of the fluid inside the well, or by a combination of the hydrostatic pressure and an additional pressure applied by the pump from the head of the well. No matter which approach is taken, the actuation mechanism 340 needs to be electrically actuated in this embodiment at the desired location where the perforating gun needs to be fixed, and then the well fluid pressure actuates the arms of the braking mechanism. As previously discussed, the actuation mechanism 340 can be activated either due to a sensor 352, or through an electric line that extends from the head of the well to the port 352.

FIG. 3 further shows two shaped charges 360 and 362 placed inside the housing 302 and a detonator cord 364 that extends to the shaped charges and is configured to fire the shaped charges. More or less than two shaped charges may be used in any given perforating gun. The shaped charge 360 is shown having a pressure sealing cap 361 that abuts the housing 302. The housing 302 may include other elements, for example, a detonator 366, an addressable switch 368, various electrical wires 370 that are typically used in a perforating gun. If more shaped charges are present, they may be distributed not only upstream the braking and setting mechanism 112, but also downstream or both upstream and downstream. In other words, the braking and setting mechanism 112 may be located anywhere along the perforating gun. However, the braking and setting mechanism is preferably located at one end of the housing 302.

Figure 4A:
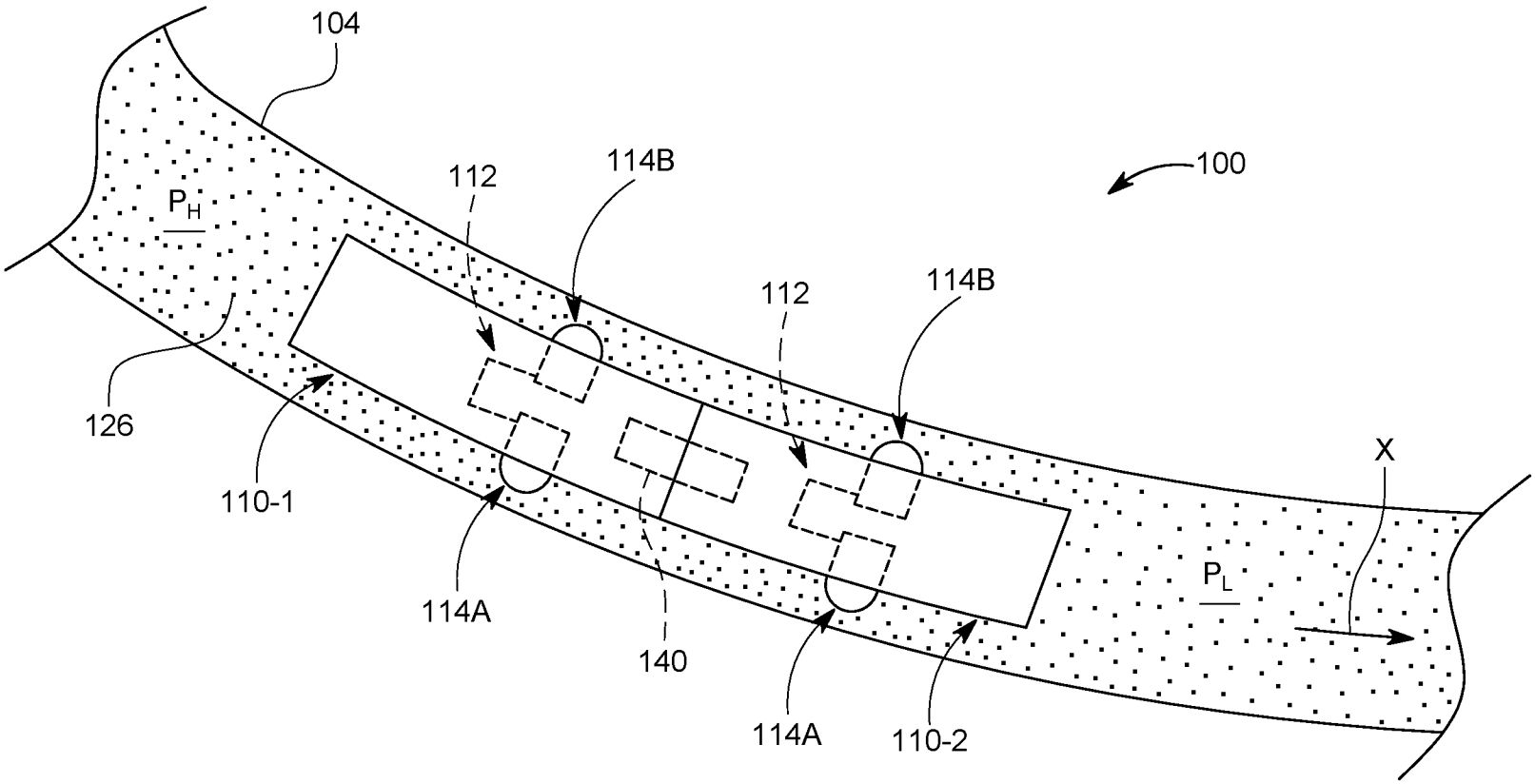
FIGS. 4A to 4D show how the braking and setting mechanism is used to brake plural perforating guns, fix one single perforating gun to the casing, and release the other perforating guns to continue their movement though the well until a next braking and setting mechanism is deployed.

In one embodiment, as illustrated in FIG. 4A, two perforating guns 110-1 and 110-2 are connected to each other by a link 140, which is discussed later in more detail. The two perforating guns travel inside the casing 104, along the positive direction of the longitudinal axis X, due to the high pressure $P_H$, that is present upstream the perforating guns. Note that the low pressure $P_L$ downstream the guns is lower than the high pressure $P_H$, and for this reason, the guns move along the positive direction of the axis X.

Figure 4B:
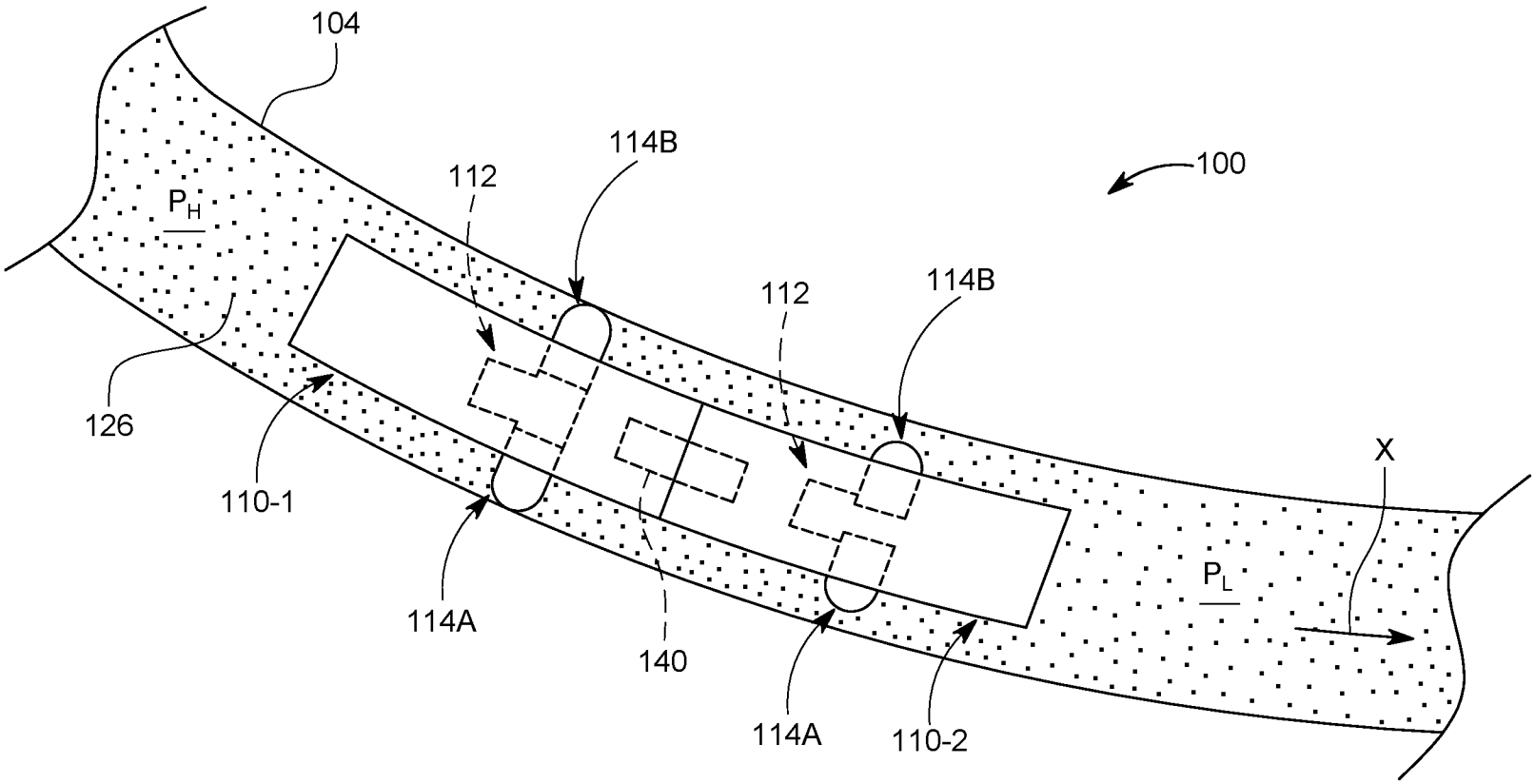
Figure 4C:
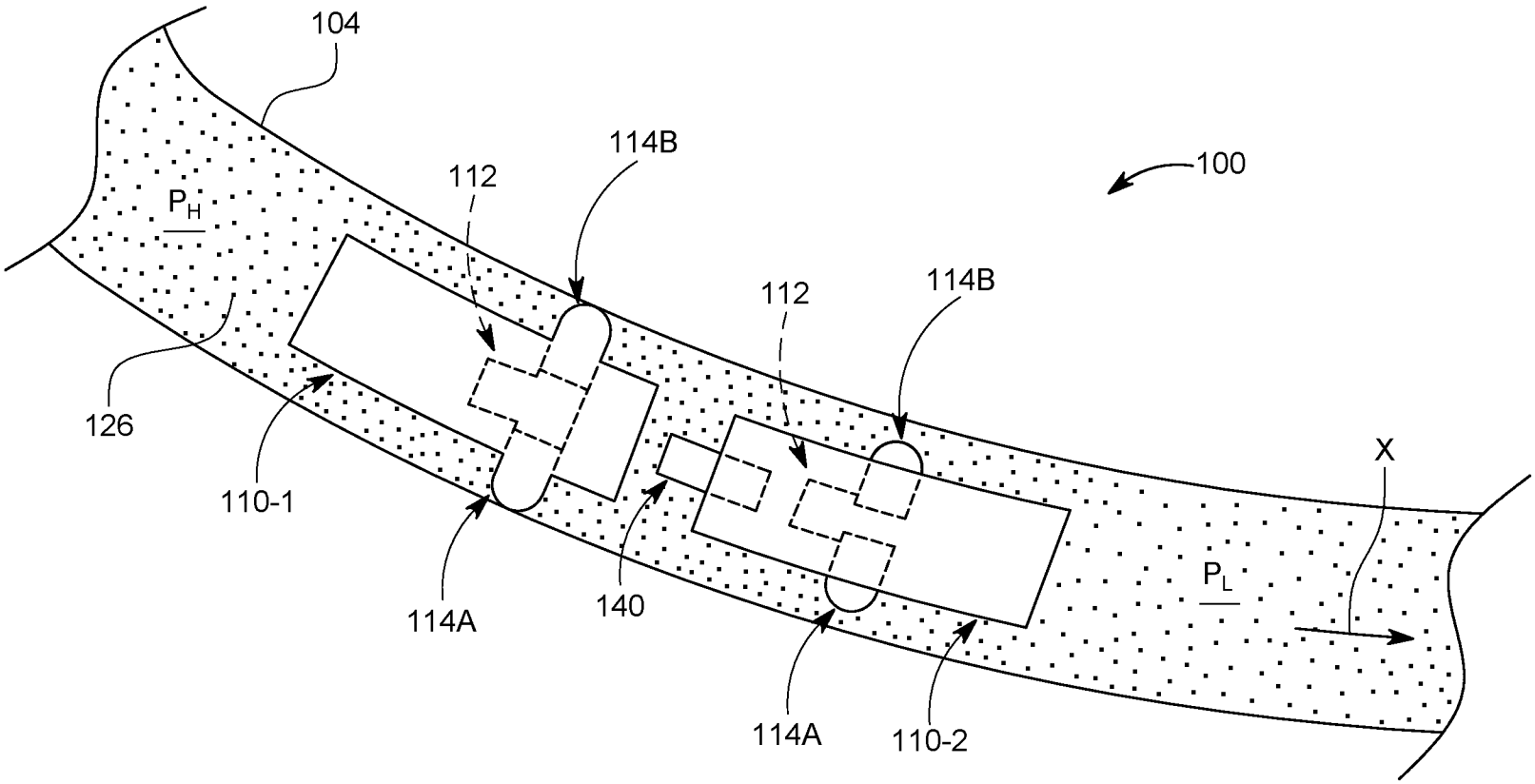
Figure 4D:
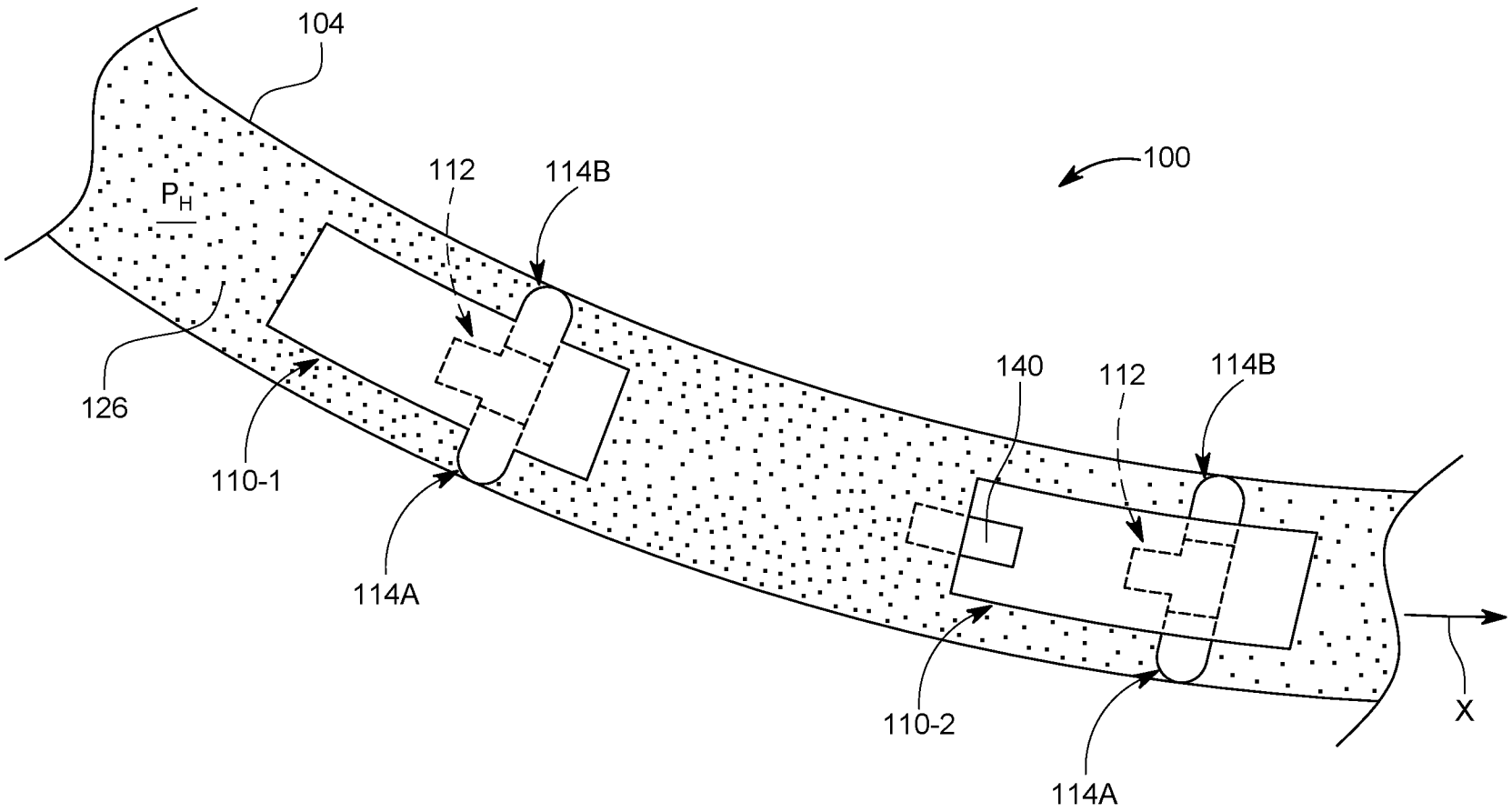

When the gun 110-1 arrives at the desired location in the casing, a command is sent through the wire 350 to the actuation mechanism 340, as discussed above. This command is sent from the controller 122, either along the slickline 354 as an electrical signal, if the slickline is present, or through the well fluid 126, as a pressure wave that is recorded by the sensor 352. The pressure wave may result in the pressure $P_H$ being modulated, for example, by the pump 120 at the surface. Alternatively, a sound modem may be used to transmit a sound through the well fluid to the sensor 352. Irrespective of how the actuation mechanism 340 is activated, once the well pressure enters inside the braking and setting mechanism 112, it forces the arms 114A and 114B to extend and fix the first perforating gun 110-1 to the casing, as shown in FIG. 4B. At this time, the entire gun assembly (i.e., both perforating guns 110-1 and 110-2) are fixed to the casing. However, if the high pressure $P_H$ is increased (for example, with the pump 120) over a predefined value, so that the force generated on the second perforating gun 110-2 is larger than the maximum force that the link 140 can withstand, the link 140 eventually separates from the first perforating gun 110-1 and frees the second perforating gun 110-2, as shown in FIG. 4C. Now this gun can freely and autonomously travel through the casing 104 until reaching another desired location, at which time the controller 122 can send another pressure wave to the sensor 352 to trigger the actuation mechanism 340 and to actuate the braking and setting mechanism 112. At this point, the arms of the second perforating gun 110-2 get activated and they extend to contact the casing and fix the gun to the casing, as shown in FIG. 4D. In this way, any number of perforating guns may be connected to each other and may be launched together into the well, in an autonomous way. Then, as each gun arrives at a corresponding desired location, a signal is sent from the controller 122 to activate the last gun in the chain, or the proximal gun relative to the head of the well. After the rest of the guns break away from the fixed gun, the process is repeated until all the guns are disconnected from each other and all the guns are fixed to the casing at the desired locations, as schematically illustrated in FIG. 4D.

If the perforating guns are attached to a slickline, then the shaped charges may be initiated by sending a command to their detonators along the slickline. However, for the case that the perforating guns are completely autonomous, i.e., no wireline, then a new configuration is necessary for activating the detonator to fire the corresponding shaped charges.

Figure 5:
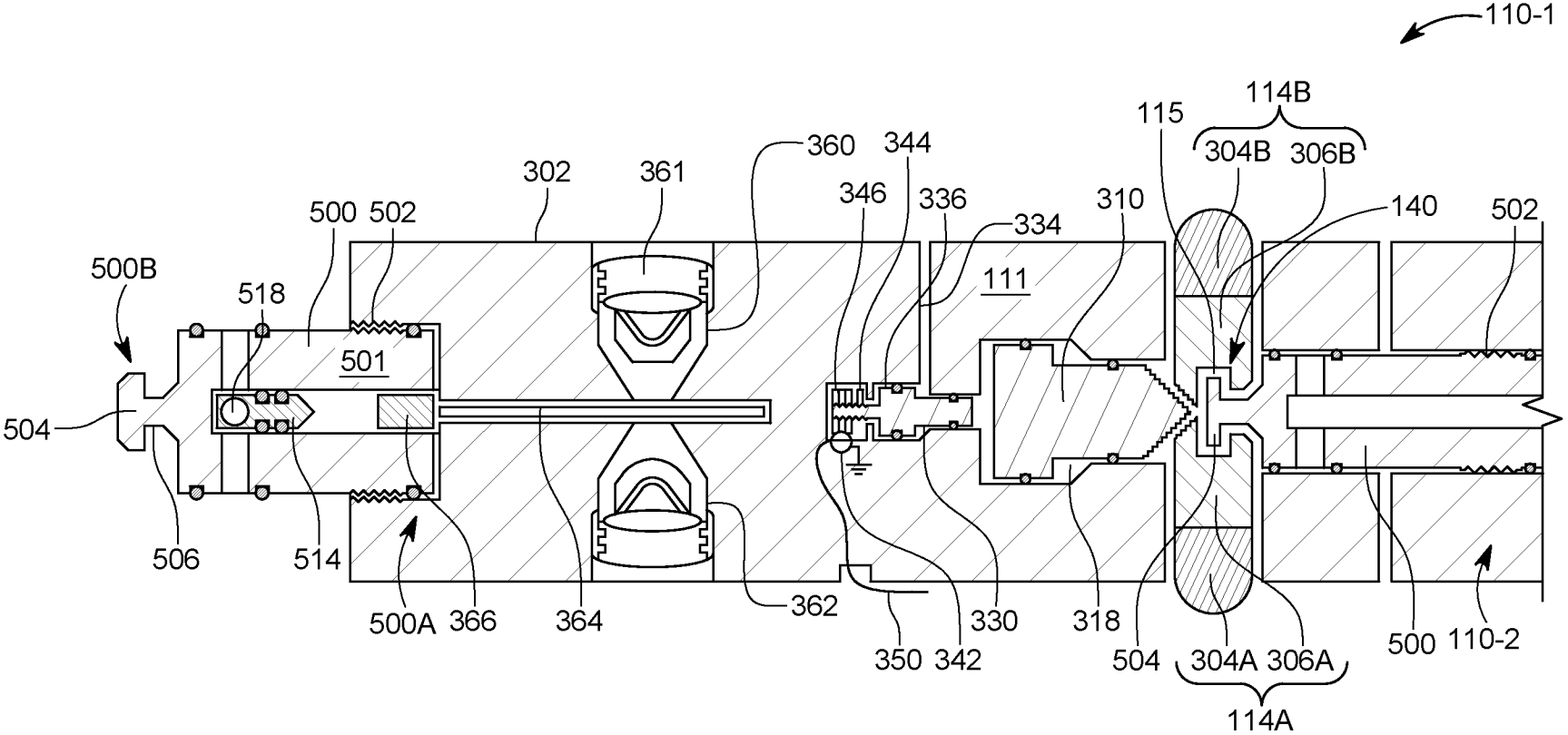
FIG. 5 shows details of another braking and setting mechanism of a perforating gun.

In this regard, FIG. 5 shows a variation of the perforating gun 110 that includes in addition to the elements shown in FIG. 3, an intercarrier connection device 500. The connection device 500 is attached with threads 502, at one end 500A, to one perforating gun 110-2, and slides at the other end 500B, into an adjacent perforating gun 110-1, as illustrated in the figure. In another words, each perforating gun is directly connected to two connection devices 500. The connection device 500 is configured to connect to each other the two adjacent perforating guns 110-1 and 110-2. The connection device 500 has a head 504 that is configured to be attached with a slim neck 506 to a body 501. In this embodiment, the head 504 is also configured to engage and lock within an internal chamber 115 formed between the arms 114A and 114B. The internal chamber 115 has a passage that fits around the neck 506 of the connection device 500. The internal chamber 115 is defined by the base portions 306A and 306B of the arms. It is noted that after the connection device 500 is threaded into the perforating gun 110-2, it can slide into the other perforating gun 110-1 to achieve the connection between the two guns. Then, to hold in place the sliding end 500B of the connection device 500, the two arms 114A and 114B may be inserted in their passages, to form the internal chamber 115, and to enclose the head 504. In this way, the connection device 500 is also fixedly attached to the perforating gun 110-1 although the end 500B, which does not have threads. Thus, the link 140 illustrated in FIGS. 4A to 4D is achieved between the two perforating guns 110-1 and 110-2 by the connection device 500.

Figure 6:
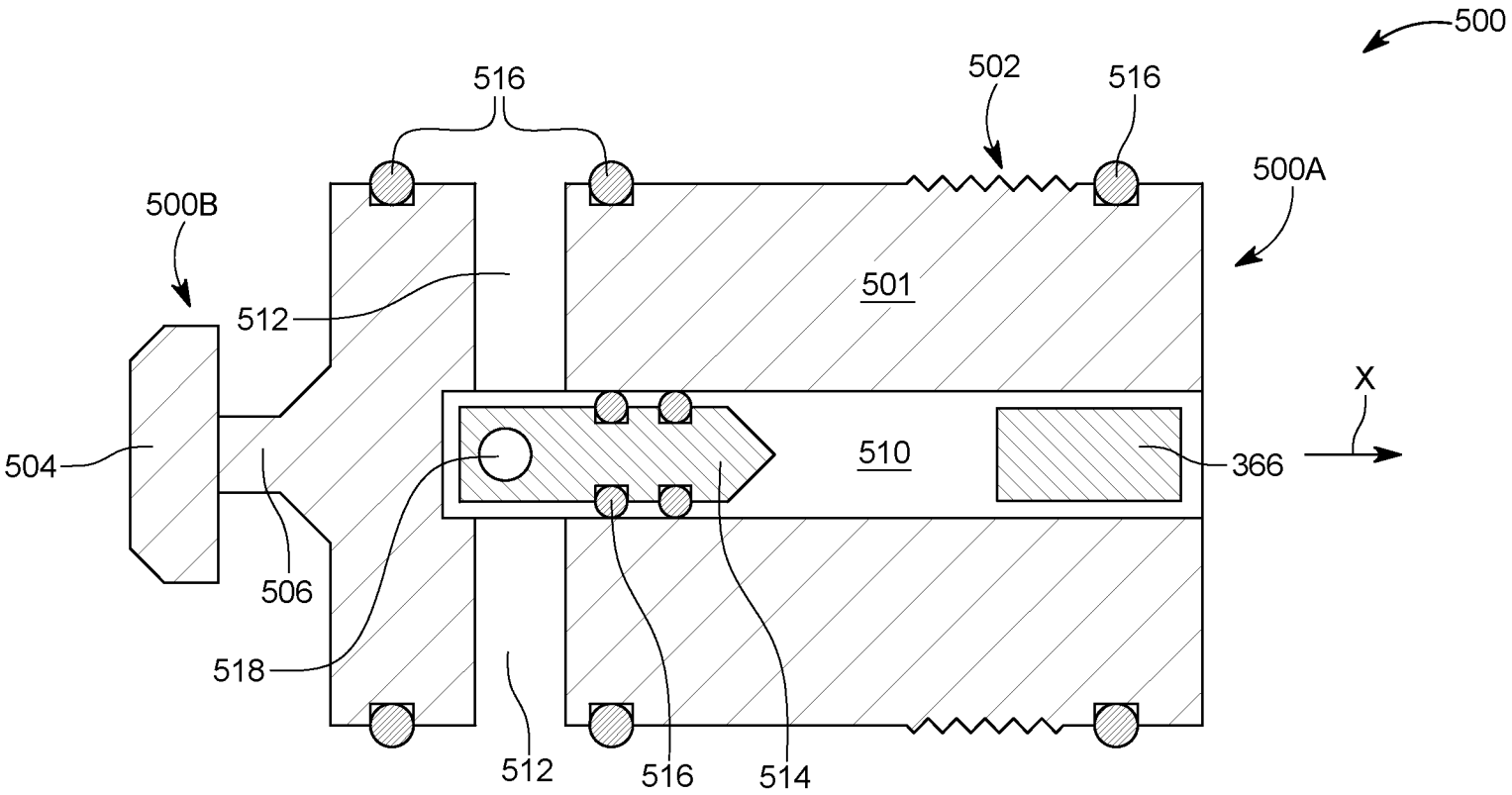
FIG. 6 illustrates an intercarrier connection device that is configured to connect two adjacent perforating guns to each other and to initiate the shaped charges in one of the two adjacent perforating guns.

The connection device 500 is shown in FIG. 6 as further including a bore 510 that starts from the end 500A and extends partially through the body 501. At a certain point, the bore 510 communicates with channels 512, that extend perpendicularly on the bore 510 and fluidly communicate with the outside of the device 500. The fluid connection between the bore 510 and the channels 512 is blocked by a moving pin 514. Both the moving pin 514 and the body 501 have corresponding o-rings 516 for sealing purposes. When the moving pin is actuated by the well fluid, it moves along the positive direction of the longitudinal axis X, and strikes the detonator 366, thus activating the associated shaped charges in the perforating gun.

To actuate the moving pin 514, various approaches may be used. In this embodiment, for example, a dissolvable collar 518 may be attached to the part of the moving pin that extends into the channels 512. The collar 518 prevents the pin 514 from entering into the bore 510. When the perforating gun is in the well, the well fluid enters through the channels 512 and start dissolving the dissolvable collar 518. Because of the various o-rings 516, the bore 510 is at this time filled with air at atmospheric pressure and the well fluid cannot enter into the bore because the moving pin seals the bore. The moving pin does not move into the bore due to the large pressure difference because the dissolvable collar prevents this move. However, once enough of the dissolvable collar has been dissolved by the well fluid, the moving pin is freed from this hold, and the pressure difference between the well fluid and the air inside the bore 510 suddenly exerts a large force on the moving pin. Due to this force, the moving pin travels with a high speed inside the bore 510, to the right in the figure, and hits the detonator 366, thus activating it. Those skilled in the art would understand that this is only one possible configuration of the connection device 500 and other configurations may be implemented based on the teachings in this disclosure.

Figure 7:
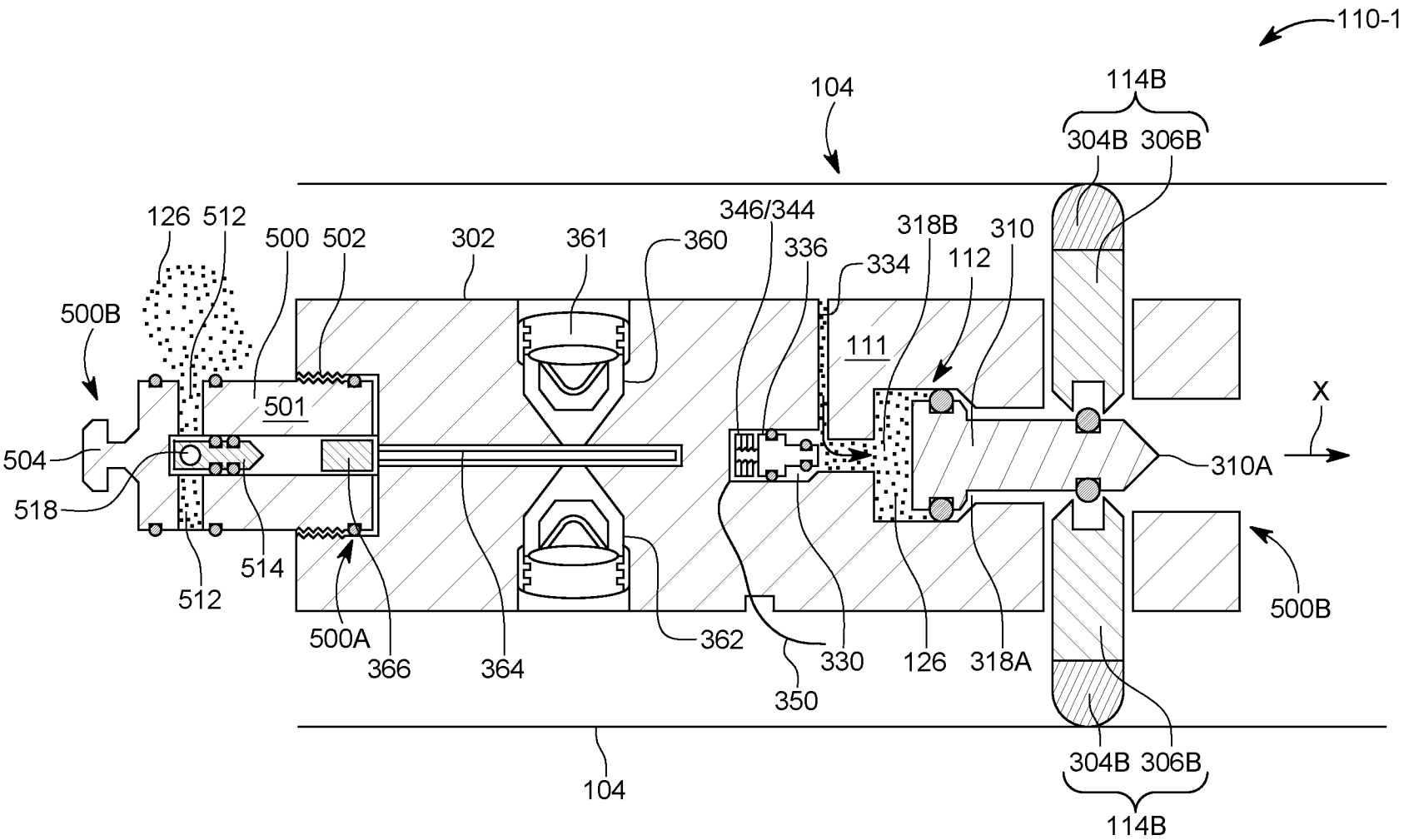
FIG. 7 illustrates a perforating gun being deployed in a well and the braking and setting mechanism being deployed.

When the connection devices 500 are used to connect together the various perforating guns that are lowered together into the casing, and after a given perforating gun is fixed relative to the casing and the other perforating guns are moved further down the casing, then the fixed perforating gun 110-1 would look as shown in FIG. 7. This means that only the connection device 500 that is threaded at the end 500A into the perforating gun is left (the connection device to the left in the figure) while the other connection device that was slid with the other end 500B is not there anymore as that connection device stayed with the other perforating gun. To activate the fixed perforating gun 110-1, the dissolvable collar 518 needs to be removed from the moving pin 514. As the channels 512 of the connection device 500 are now exposed to the well fluid 126, the dissolvable collar 518 starts to dissolve. After a predetermined time, which was calculated by the operator when designing the dissolvable collar, the moving pin 514 is freed and due to the high force applied by the pressured well fluid, it moves the moving pin to hit the detonator 366. The detonator 366 is detonated, which ignites the detonator cord 364, which in turn activates the shaped charges 360 and 362 and thus, the perforating gun is perforating the casing 104. FIG. 7 also shows the movable piston 310 being moved along the positive direction of the longitudinal axis X, and pushing the two arms 114A and 1146 of the braking and setting mechanism 112 against the casing 104. Note that the tip 310A of the movable piston 310 pushed out the connection device 500 of the adjacent perforating gun 110-2 so that the two perforating guns have separated from each other. Also note that one or more of the elements of the braking and setting mechanism 112 are made of dissolvable materials.

Figure 8:
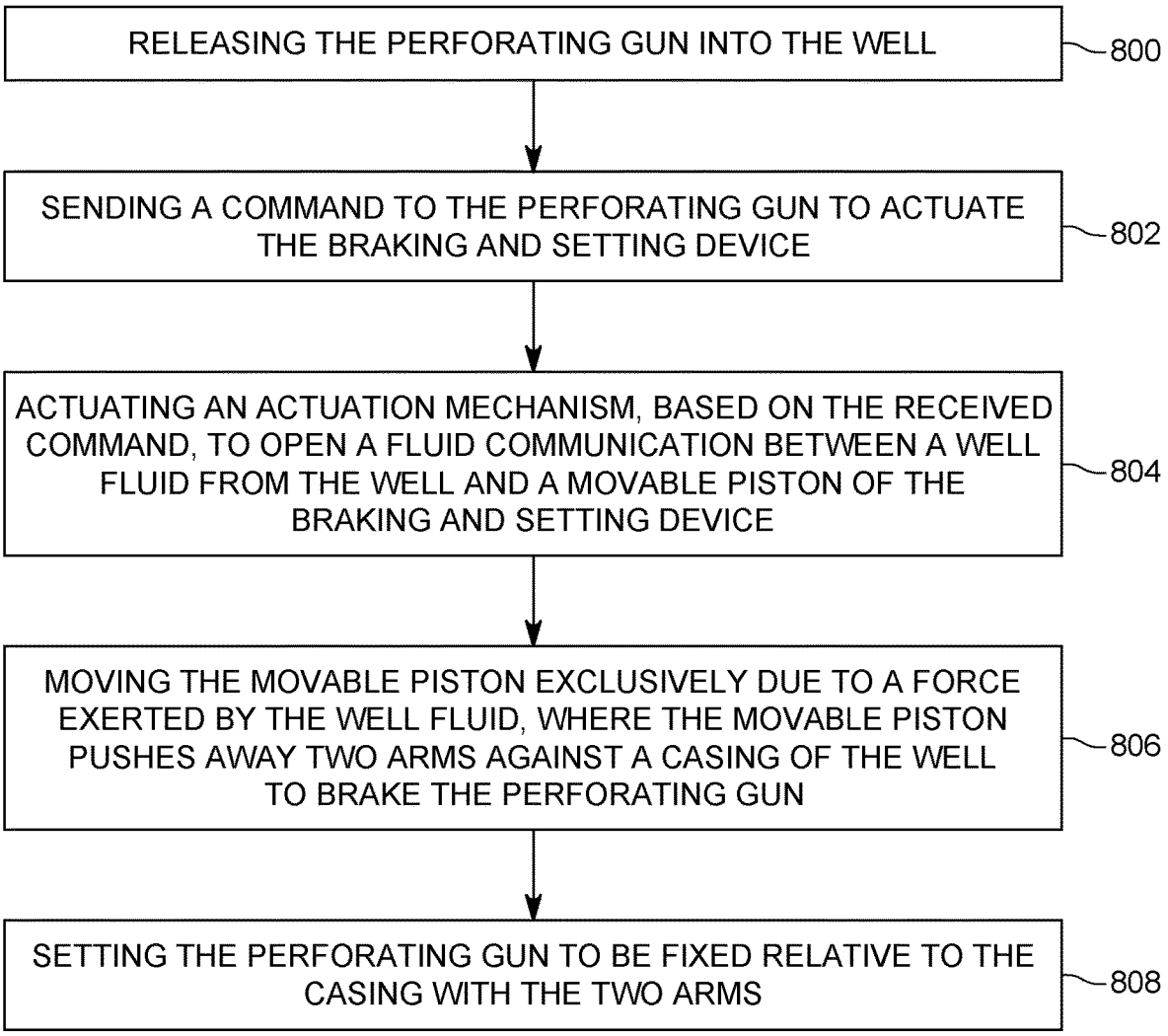
FIG. 8 is a flow chart of a method for deploying the braking and setting mechanism in the well.

A method for deploying a perforating gun into a well with the help of a braking and setting device is now discussed with regard to FIG. 8. The method includes a step 800 of releasing the perforating gun into the well, a step 802 of sending a command to the perforating gun to actuate the braking and setting device, a step 804 of actuating an actuation mechanism, based on the received command, to open a fluid communication between a well fluid from the well and a movable piston of the braking and setting device, a step 806 of moving the movable piston exclusively due to a force exerted by the well fluid, where the movable piston pushes away two arms against a casing of the well to brake the perforating gun, and a step 808 of setting the perforating gun to be fixed relative to the casing with the two arms.

The disclosed embodiments provide methods and mechanisms for braking the movement of a tool inside a well and fixing the tool relative to the well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A braking and setting device configured to slow down a movement of a tool in a well and to fix the tool relative to the well, the braking and setting device comprising:

two or more arms configured to extend from the tool, toward the well, to brake the movement of the tool along a longitudinal axis X;

a movable piston configured to be hosted fully within the tool and to move only when a well fluid acts on a base portion of the movable piston, while a tip portion of the movable piston pushes away the two or more arms; and an actuation mechanism configured to move from a first position, in which it prevents fluid communication between the well fluid and the base portion of the movable piston, to a second position, in which it allows fluid communication between the well fluid and the base portion of the movable piston, wherein the movable piston moves exclusively due to a force exerted by the well fluid on the movable piston.

2. The device of claim 1, wherein at least one of the two or more arms, the movable piston and the actuation mechanism are made of a dissolvable material, which is configured to dissolve into smaller parts when in contact with the well fluid.

3. The device of claim 1, wherein each arm of the two or more arms includes a tip portion that is made of rubber.

4. The device of claim 1, wherein a bottom area of the movable piston is larger than a top area of the movable piston so that a differential pressure is formed when the well fluid acts on the movable piston.

5. The device of claim 1, wherein the actuation mechanism acts as an open valve when receiving an electrical signal.

6. The device of claim 5, wherein the electrical signal is received at a port, from a wireline that extends from the surface.

7. The device of claim 5, wherein the actuation mechanism comprises:

a sensor that generates the electrical signal in response to a pressure change in the well fluid.

8. The device of claim 5, wherein the actuation mechanism comprises:

another movable piston that blocks a fluid communication between a channel that communicates with an exterior of the tool and a chamber in which the movable piston is located.

9. The device of claim 8, wherein the actuation mechanism further comprises:

a spring;

a fuse that is configured to receive the electrical signal and release the string, which in turn releases the another movable piston to unblock the fluid communication between the exterior of the tool and the chamber.

10. A perforating gun configured to slow down in a well and fix to a casing of the well, the perforating gun comprising:

a body extending along a longitudinal axis X;

one or more shaped charges configured to make a perforation in the well;

a detonator cord connected to the one more shaped charges; and a braking and setting device partially located within the body and configured to slow down a movement of the body in the well and to fix the body relative to the well, wherein the braking and setting device brakes and sets the body exclusively due to a force exerted by the well fluid.

11. The perforating gun of claim 10, wherein the braking and setting device comprises:

two or more arms configured to extend from the body, toward the well, to brake the movement of the body along the longitudinal axis X;

a first movable piston configured to be fully hosted within the body and to move only when the well fluid acts on a base portion of the first movable piston, while a tip portion of the first movable piston pushes away the two or more arms; and an actuation mechanism configured to establish a fluid communication between the well fluid and the base portion of the first movable piston, wherein the first movable piston moves exclusively due to the force exerted by the well fluid on the movable piston.

12. The perforating gun of claim 11, wherein at least one of the two or more arms, the movable piston and the actuation mechanism are made of a dissolvable material, which is configured to dissolve into smaller parts when in contact with the well fluid.

13. The perforating gun of claim 11, wherein there is a channel between an exterior of the perforating gun and the actuation mechanism that brings the well fluid in contact with a second movable piston of the actuation mechanism.

14. The perforating gun of claim 13, wherein the body includes a first internal chamber that hosts the first movable piston, and a second internal chamber that hosts the second movable piston, and a fluid communication between the first and second internal chambers is blocked by the second movable piston.

15. The perforating gun of claim 14, wherein the second movable piston unblocks the fluid communication between the first and second internal chambers when a command is received along a wire at the actuation mechanism.

16. The perforating gun of claim 15, wherein the command is received at a port, from a wireline that extends from the surface.

17. The perforating gun of claim 15, wherein the actuation mechanism comprises:

a sensor that generates the command in response to a pressure change in the well fluid.

18. The perforating gun of claim 15, wherein the actuation mechanism further comprises:

a spring; and a fuse that is configured to receive the command and release the string, which in turn releases the second movable piston to move under a force exerted by the well fluid.

19. The perforating gun of claim 15, further comprising:

a connection device that includes a detonator, wherein the connection device has threads at one end that connect to the body and no threads at the other end so that the connection device slides into an adjacent perforating gun.

20. A method of deploying a perforating gun into a well with a braking and setting device, the method comprising:

releasing the perforating gun into the well;

sending a command to the perforating gun to actuate the braking and setting device;

actuating an actuation mechanism, based on the received command, to open a fluid communication between a well fluid from the well and a movable piston of the braking and setting device;

moving the movable piston exclusively due to a force exerted by the well fluid, where the movable piston pushes away two or more arms against a casing of the well to brake the perforating gun; and setting the perforating gun to be fixed relative to the casing with the two or more arms.

* * * * *